US006032855A

United States Patent [19]

Douglas

[11] Patent Number: 6,032,855

[45] Date of Patent: Mar. 7, 2000

[54] MESSAGE DISPLAY APPARATUS

[76] Inventor: Brenda F. Douglas, 4935 Bernadine Dr., San Antonio, Tex. 78220

[21] Appl. No.: 09/116,972

[22] Filed: Jul. 16, 1998

[51] Int. Cl.[7] ..... B65D 91/00

[52] U.S. Cl. ..... 232/17; 232/45; 232/19; 232/1 D; 312/245; 40/661.02

[58] Field of Search ..... 232/17, 45, 1 D, 232/19, 22, 1 R, 29, 33; 40/655, 661.02; 312/102, 230, 245, 234.1, 223.5, 330.1; 108/23

[56] References Cited

U.S. PATENT DOCUMENTS

| | | | |
|---|---|---|---|
| 143,804 | 10/1873 | Boyle | 232/17 |
| 462,224 | 10/1891 | Strong | 232/17 |
| 547,187 | 10/1895 | Shaw | 232/19 |
| 651,958 | 6/1900 | Trevett | 232/33 |
| 668,513 | 2/1901 | Fyfe | 232/19 |
| 948,531 | 2/1910 | Stevenson | 232/19 |
| 1,153,548 | 9/1915 | Gast | 232/19 |
| 1,245,136 | 10/1917 | Turnbull | 232/22 |
| 1,613,759 | 1/1927 | Loftin | 232/19 |
| 1,804,871 | 5/1931 | Helland | 40/661.06 |
| 2,092,681 | 9/1937 | Reilly | 232/33 |
| 2,860,830 | 11/1958 | Mrenza | 232/45 |
| 4,790,088 | 12/1988 | Morvant | 40/124.5 |
| 5,000,380 | 3/1991 | Barrios | 232/19 X |

*Primary Examiner*—Brian K. Green
*Assistant Examiner*—William L. Miller

[57] ABSTRACT

A message display apparatus for displaying messages and receiving mail includes a body which is attachable to a structure. A note pad is coupled to the front surface of the body. The front surface of the body also has a drawer slidably inserted into the interior of the body and a slot therein providing an opening into the drawer. A pair of spaced apart hooks downwardly extend from the lower end of the body.

20 Claims, 3 Drawing Sheets

MESSAGE DISPLAY APPARATUS

BACKGROUND OF THE INVENTION

1. Field of the Invention

The present invention relates to devices for displaying messages and more particularly pertains to a new message display apparatus for displaying messages and receiving mail.

2. Description of the Prior Art

The use of devices for displaying messages is known in the prior art. More specifically, devices for displaying messages heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for displaying messages include U. S. Pat. No. 5,176,522; U.S. Pat. No. 5,430,965; U.S. Pat. No. Des. 331,263; U.S. Pat. No. 5,035,626; U.S. Pat. No. 4,153,927; and U.S. Pat. No. 5,131,849.

While these devices fulfill their respective, particular objectives and requirements, the aforementioned patents do not disclose a new message display apparatus. The inventive device includes a body which is attachable to a structure. A note pad is coupled to the front surface of the body. The front surface of the body also has a drawer slidably inserted into the interior of the body and a slot therein providing an opening into the drawer. A pair of spaced apart hooks downwardly extend from the lower end of the body.

In these respects, the message display apparatus according to the present invention substantially departs from the conventional concepts and designs of the prior art, and in so doing provides an apparatus primarily developed for the purpose of displaying messages and receiving mail.

SUMMARY OF THE INVENTION

In view of the foregoing disadvantages inherent in the known types of devices for displaying messages now present in the prior art, the present invention provides a new message display apparatus construction wherein the same can be utilized for displaying messages and receiving mail.

The general purpose of the present invention, which will be described subsequently in greater detail, is to provide a new message display apparatus apparatus and method which has many of the advantages of the devices for displaying messages mentioned heretofore and many novel features that result in a new message display apparatus which is not anticipated, rendered obvious, suggested, or even implied by any of the prior art devices for displaying messages, either alone or in any combination thereof.

To attain this, the present invention generally comprises a body which is attachable to a structure. A note pad is coupled to the front surface of the body. The front surface of the body also has a drawer slidably inserted into the interior of the body and a slot therein providing an opening into the drawer. A pair of spaced apart hooks downwardly extend from the lower end of the body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new message display apparatus apparatus and method which has many of the advantages of the devices for displaying messages mentioned heretofore and many novel features that result in a new message display apparatus which is not anticipated, rendered obvious, suggested, or even implied by any of the prior art devices for displaying messages, either alone or in any combination thereof.

It is another object of the present invention to provide a new message display apparatus which may be easily and efficiently manufactured and marketed.

It is a further object of the present invention to provide a new message display apparatus which is of a durable and reliable construction.

An even further object of the present invention is to provide a new message display apparatus which is susceptible of a low cost of manufacture with regard to both materials and labor, and which accordingly is then susceptible of low prices of sale to the consuming public, thereby making such message display apparatus economically available to the buying public.

Still yet another object of the present invention is to provide a new message display apparatus which provides in the apparatuses and methods of the prior art some of the advantages thereof, while simultaneously overcoming some of the disadvantages normally associated therewith.

Still another object of the present invention is to provide a new message display apparatus for displaying messages and receiving mail.

Yet another object of the present invention is to provide a new message display apparatus which includes a body which is attachable to a structure. A note pad is coupled to the front surface of the body. The front surface of the body also has a drawer slidably inserted into the interior of the body and a slot therein providing an opening into the drawer. A pair of spaced apart hooks downwardly extend from the lower end of the body.

Still yet another object of the present invention is to provide a new message display apparatus that is attachable to a structure such as the outside of a home or a business to provide a source for displaying information thereon.

Even still another object of the present invention is to provide a new message display apparatus that can be used to collect mail and other messages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
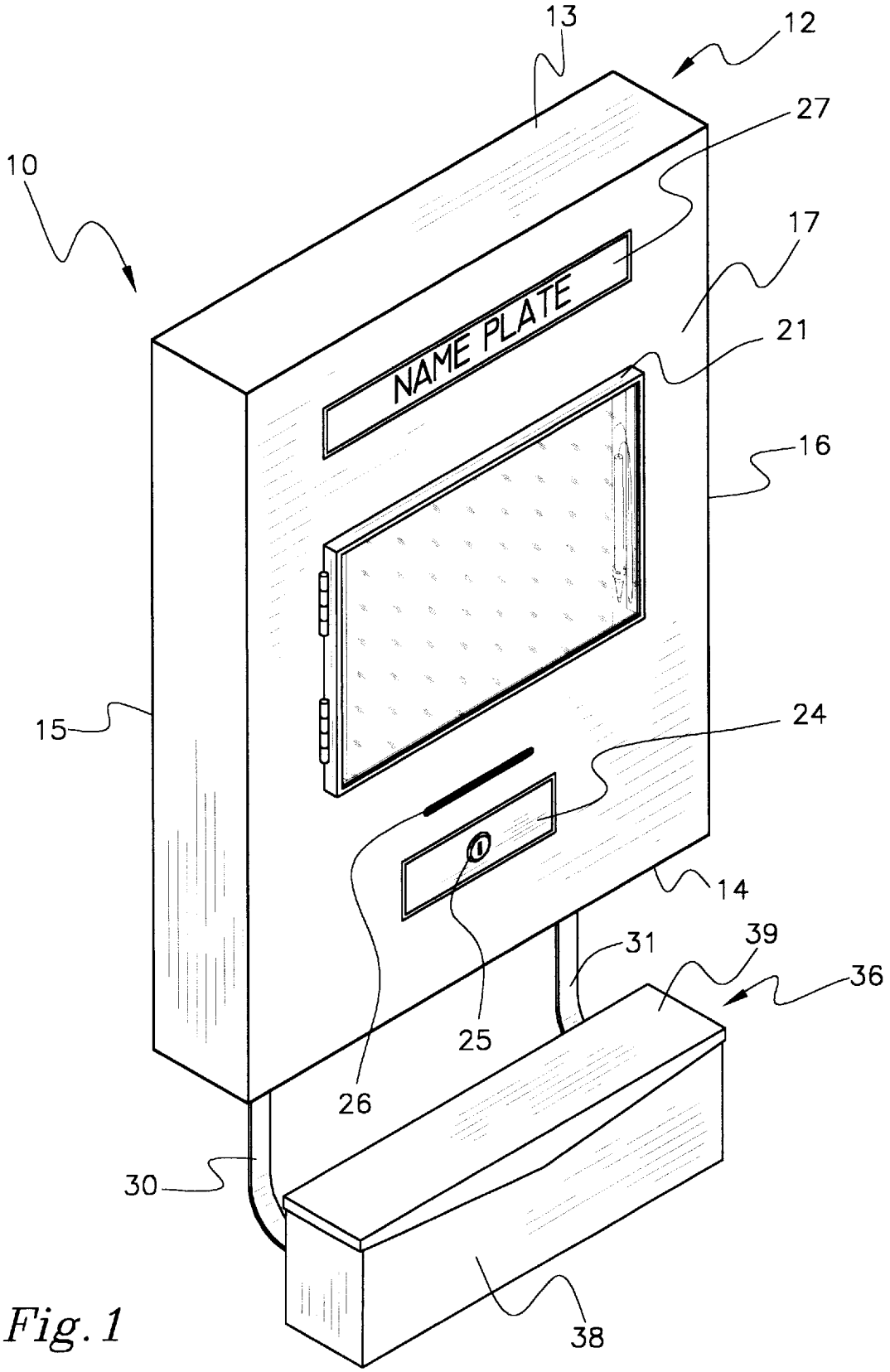
FIG. 1 is a schematic perspective view of a new message display apparatus according to the present invention.
Figure 2:
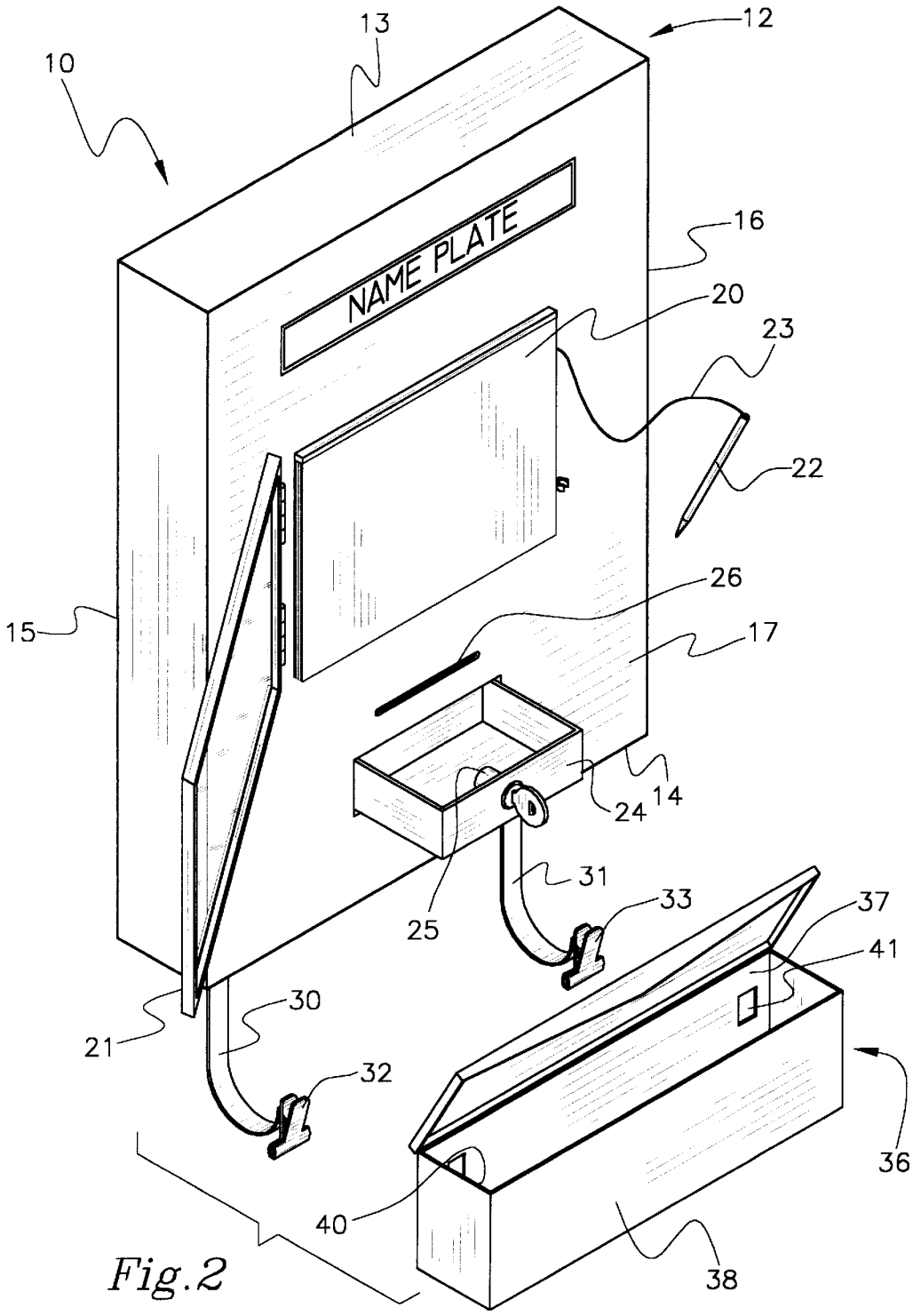
FIG. 2 is a schematic exploded perspective view of the present invention.
Figure 3:
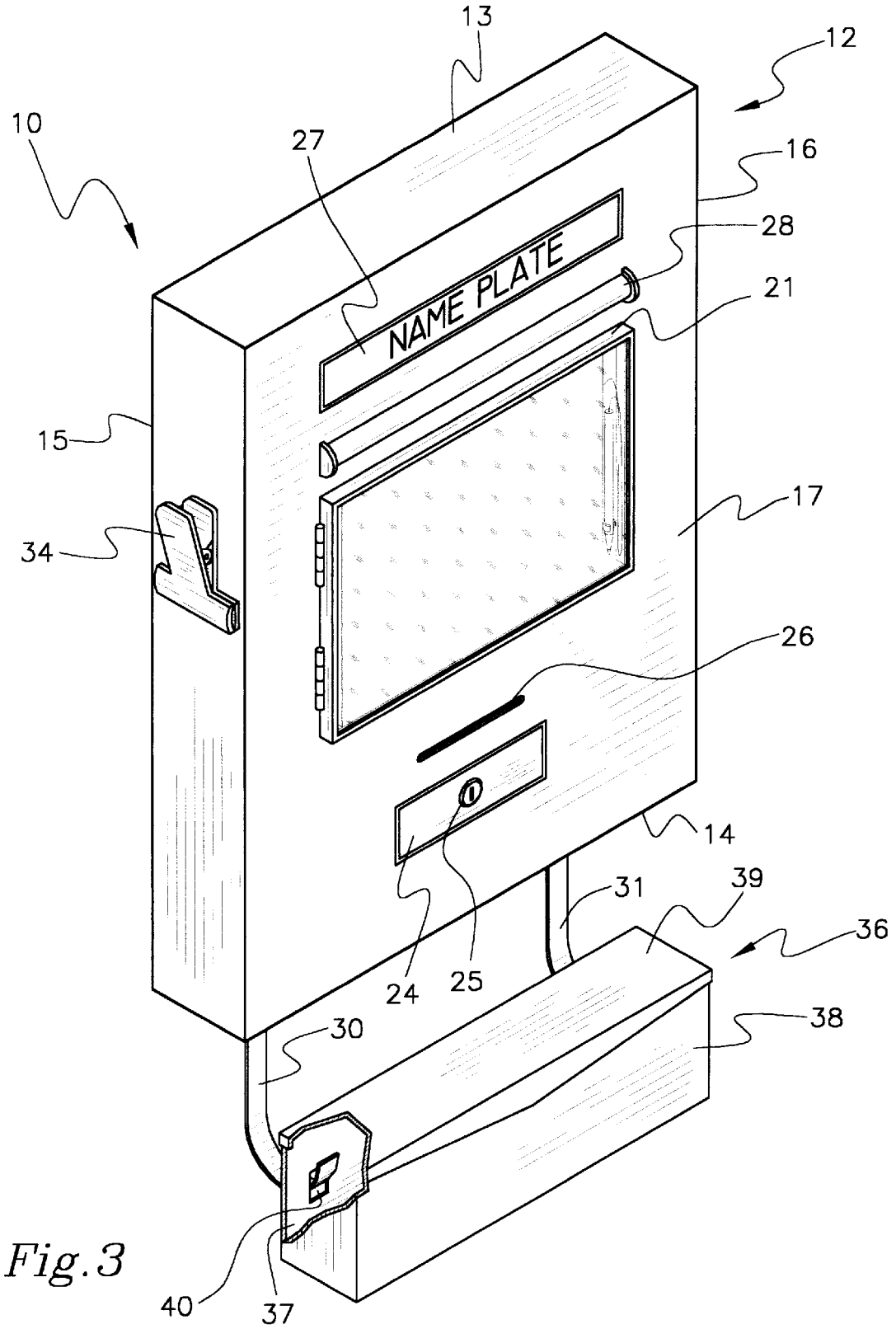
FIG. 3 is a schematic perspective view of an ideal embodiment of the present invention.

With reference now to the drawings, and in particular to FIGS. 1 through 3 thereof, a new message display apparatus embodying the principles and concepts of the present invention and generally designated by the reference numeral 10 will be described.

As best illustrated in FIGS. 1 through 3, the message display apparatus 10 generally comprises a body 12 which is attachable to a structure. A note pad 20 is coupled to the front surface 17 of the body 12. The front surface 17 of the body 12 also has a drawer 24 slidably inserted into the interior of the body 12 and a slot 26 therein providing an opening into the drawer 24. A pair of spaced apart hooks 30,31 downwardly extend from the lower end of the body 12.

In use, the apparatus 10 is designed for mounting to a structure such as a wall so that users may leave notes, messages and other information to others with the apparatus 10. In closer detail, the body 12 is generally rectangular and has upper and lower ends 13,14, and a pair of sides 15,16 extending between the upper and lower ends 13,14 of the body 12. The body 12 is attachable to a structure. The body 12 has a length defined between the upper and lower ends 13,14 of the body 12, and a width is defined between the sides 15,16 of the body 12. Preferably, the width of the body 12 is less than about two-thirds the length of the body 12. Ideally, the length of the body 12 is less than about 24 inches and the width of the body 12 is less than about 18 inches.

The note pad 20 is generally rectangular and preferably has a plurality of sheets of paper. The note pad 20 is coupled to the front surface 17 of the body 12. A cover plate 21 substantially covers the note pad 20 on the front surface 17 of the body 12. The cover plate 21 is hingedly coupled to the front surface 17 of the body 12 such that the cover plate 21 may be pivoted to expose the note pad 20. Preferably, the cover plate 21 is generally rectangular and generally transparent so that messages written on the note pad may be seen when the cover plate is covering the note pad. In the preferred embodiment, a writing instrument 22 is provided for enabling a user to write on the note pad 20. A elongate flexible line 23 couples the writing instrument 22 to the front surface 17 of the body 12.

The front surface 17 of the body 12 also has a drawer 24 slidably inserted into the interior of the body 12. The drawer 24 is securable by a lock 25 to prevent removal of the drawer 24 from the body 12 when the drawer 24 is shut. Preferably, the drawer 24 is located between the note pad 20 and the lower end 14 of the body 12. The front surface 17 of the body 12 has a slot 26 therein providing an opening into the drawer 24. The slot 26 is located between the drawer 24 and the note pad 20 and is designed for inserting messages and business cards into the drawer 24 when it is shut.

Ideally, a generally rectangular name plate 27 is coupled to the front surface 17 of the body 12. The name plate 27 is designed for displaying indicia such as a person's or a business's name thereon. Even more ideally, the name plate 27 is located between the upper end of the body 12 and the note pad 20. In this ideal embodiment, it is preferred that a light source 28 be provided on the front surface 17 of the body 12. The light source 28 is positioned between the name plate 27 and the note pad 20.

The pair of spaced apart hooks 30,31 are downwardly extended from the lower end of the body 12. Each of the hooks 30,31 is generally J-shaped and has an arcuate portion terminating at a free end. The arcuate portion is designed for holding cylindrically rolled items such as tube containers and rolled papers. A pair of spring clips 32,33 are provided for holding items with one of the spring clips 32 detachably attached to the free end of one of the hooks 30 and the other spring clip detachably attached to the free end of the other hook 31. In the preferred embodiment, a third spring clip 34 of holding items is coupled to one of the sides 15,16 of the body 12.

A generally rectangular container 36, or mail box, has a front 38, a back 37, an open top, and a lid 39. The lid 39 is pivotally coupled to the back 37 of the container 36 and substantially covers the open top of the container 36. The back 37 of the container 36 has a pair of spaced apart holes 40,41. The free end of one of the hooks 30 is insertable into one of the holes 40 while the free end of the other hook 31 is insertable into the other hole 41 preferably when the pair of spring clips 32,33 are detached from the free ends of the hooks 30,31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for mounting to a structure, said apparatus comprising:

a body having an interior, a front surface, upper and lower ends, and a pair of sides extending between said upper and lower ends of said body, said lower end of said body defining a plane, said body being adapted for attaching to the structure;

a note pad being coupled to said front surface of said body;

said front surface of said body having a drawer slidably inserted into said interior of said body;

said front surface of said body having a slot therein providing an opening into said drawer; and a pair of spaced apart hooks being downwardly extended from said lower end of said body, each of said hooks being generally J-shaped and including a portion directly attached to said lower end of said body and an arcuate portion terminating at a free end, each of said hooks being mounted in a manner such that said hooks are positioned entirely below the lower end plane of said body such that said hooks are adapted to receive and support an object below said body.

2. The apparatus of claim 1, wherein said body is generally rectangular, wherein said body has a length defined between said upper and lower ends of said body, wherein said body has a width being defined between said sides of said body, wherein said width of said body is less than about two-thirds the length of said body.

3. The apparatus of claim 2, wherein said length of said body is less than about 24 inches, and wherein said width of said body is less than about 18 inches.

4. The apparatus of claim 1, further comprising a cover plate substantially covering said note pad, said cover plate being hingedly coupled to said front surface of said body.

5. The apparatus of claim 1, further comprising a writing instrument and an elongate flexible line coupling said writing instrument to said front surface of said body.

6. The apparatus of claim 1, wherein said drawer is located between said note pad and said lower end of said body, wherein said slot is located between said drawer and said note pad.

7. The apparatus of claim 1, further comprising a name plate being coupled to said front surface of said body, said name plate being for displaying indicia thereon.

8. The apparatus of claim 7, wherein said name plate is located between said upper end of said body and said note pad.

9. The apparatus of claim 8, further comprising a light source being provided on said front surface of said body, said light source being positioned between said name plate and said note pad.

10. An apparatus for mounting to a structure, said apparatus comprising:

a body having an interior, a front surfaces upper and lower ends, and a pair of sides extending between said upper and lower ends of said body, said body being adapted for attaching to the structure;

a note pad being coupled to said front surface of said body;

said front surface of said body having a drawer slidably inserted into said interior of said body;

said front surface of said body having a slot therein providing an opening into said drawer;

a pair of spaced apart hooks being downwardly extended from said lower end of said body, each of said hooks being generally J-shaped and having an arcuate portion terminating at a free end; and a pair of spring clips for holding items, one of said spring clips being detachably attached to said free end of one of said hooks, the other of said spring clips being detachably attached to said free end of the other of said hooks.

11. The apparatus of claim 10, further comprising a third spring clip for holding items being coupled to one of said sides of said body.

12. The apparatus of claim 10, wherein said body is generally rectangular, wherein said body has a length defined between said upper and lower ends of said body, wherein said body has a width being defined between said sides of said body, wherein said width of said body is less than about two-thirds the length of said body.

13. The apparatus of claim 12, wherein said length of said body is less than about 24 inches, and wherein said width of said body is less than about 18 inches.

14. The apparatus of claim 10, further comprising a cover plate substantially covering said note pad, said cover plate being hingedly coupled to said front surface of said body.

15. The apparatus of claim 10, further comprising a writing instrument and an elongate flexible line coupling said writing instrument to said front surface of said body.

16. The apparatus of claim 10, wherein said drawer is located between said note pad and said lower end of said body, wherein said slot is located between said drawer and said note pad.

17. The apparatus of claim 10, further comprising a name plate being coupled to said front surface of said body, said name plate being for displaying indicia thereon.

18. The apparatus of claim 17, further comprising a light source being provided on said front surface of said body, said light source being positioned between said name plate and said note pad.

19. An apparatus for mounting to a structure, said apparatus comprising:

a body having an interior, a front surface, upper and lower ends, and a pair of sides extending between said upper and lower ends of said body, said body being adapted for attaching to the structure;

a note pad being coupled to said front surface of said body;

said front surface of said body having a drawer slidably inserted into said interior of said body;

said front surface of said body having a slot therein providing an opening into said drawer;

a pair of spaced apart hooks being downwardly extended from said lower end of said body, each of said hooks being generally J-shaped and having an arcuate portion terminating at a free end; and a container having a front, a back, an open top, and a lid, said lid being pivotally coupled to said back of said container and substantially covering said open top of said container, said back of said container having a pair of spaced apart holes, said free end of one of said hooks being insertable into one of said holes of said back of said container, said free end of another of said hooks being insertable into another of said holes of said back of said container.

20. An apparatus for mounting to a structure, said apparatus comprising:

a body being generally rectangular and having an interior, a front surface, upper and lower ends, and a pair of sides extending between said upper and lower ends of said body, said body being adapted for attaching to the structure;

wherein said body has a length defined between said upper and lower ends of said body, said length of said body being less than about 24 inches;

wherein said body has a width being defined between said sides of said body, wherein said width of said body is less than about two-thirds the length of said body, wherein said width of said body is less than about 18 inches;

a note pad being generally rectangular and having a plurality of sheets, said note pad being coupled to said front surface of said body;

a cover plate being generally transparent and being generally rectangular, said cover plate substantially covering said note pad, said cover plate being hingedly coupled to said front surface of said body;

a writing instrument;

a elongate flexible line coupling said writing instrument to said front surface of said body;

said front surface of said body having a drawer slidably inserted into said interior of said body, said drawer being located between said note pad and said lower end of said body;

said front surface of said body having a slot therein providing an opening into said drawer, said slot being located between said drawer and said note pad;

a name plate being generally rectangular and being coupled to said front surface of said body, said name plate being for displaying indicia thereon, said name plate being located between said upper end of said body and said note pad;

a light source being provided on said front surface of said body, said light source being positioned between said name plate and said note pad;

a pair of spaced apart hooks being downwardly extended from said lower end of said body, each of said hooks being generally J-shaped and having an arcuate portion terminating at a free end;

a pair of spring clips for holding items, one of said spring clips being detachably attached to said free end of one of said hooks, the other of said spring clips being detachably attached to said free end of the other of said hooks;

a third spring clip for holding items being coupled to one of said sides of said body; and a container being generally rectangular and having a front, a back, an open top, and a lid, said lid being pivotally coupled to said back of said container and substantially covering said open top of said container, said back of said container having a pair of spaced apart holes, said free end of one of said hooks being insertable into one of said holes of said back of said container, said free end of another of said hooks being insertable into another of said holes of said back of said container.

* * * * *